US007995788B2

(12) United States Patent
Funahashi et al.

(10) Patent No.: US 7,995,788 B2
(45) Date of Patent: Aug. 9, 2011

(54) LOUDSPEAKER

(75) Inventors: Osamu Funahashi, Mie (JP); Hiroyuki Morimoto, Mie (JP); Kazuyoshi Umemura, Mie (JP)

(73) Assignee: Panasonic Corporation, Osaka (JP)

( * ) Notice: Subject to any disclaimer, the term of this patent is extended or adjusted under 35 U.S.C. 154(b) by 521 days.

(21) Appl. No.: 12/298,999

(22) PCT Filed: Apr. 25, 2008

(86) PCT No.: PCT/JP2008/001086

§ 371 (c)(1),
(2), (4) Date: Oct. 29, 2008

(87) PCT Pub. No.: WO2008/136182

PCT Pub. Date: Nov. 13, 2008

(65) Prior Publication Data

US 2010/0172536 A1 Jul. 8, 2010

(30) Foreign Application Priority Data

Apr. 26, 2007 (JP) ..... 2007-116930

(51) Int. Cl.
*H04R 1/00* (2006.01)

(52) U.S. Cl. ..... 381/400; 328/409

(58) Field of Classification Search ..... 381/400–431
See application file for complete search history.

(56) References Cited

U.S. PATENT DOCUMENTS

| | | | | |
|---|---|---|---|---|
| 5,835,612 | A * | 11/1998 | Fujihira et al. | 381/421 |
| 7,149,322 | B2 * | 12/2006 | Kuribayashi et al. | 381/412 |
| 7,203,333 | B2 * | 4/2007 | Funahashi et al. | 381/403 |
| 7,324,659 | B2 * | 1/2008 | Funahashi et al. | 381/398 |
| 7,532,736 | B2 * | 5/2009 | Funahashi | 381/412 |
| 7,627,133 | B2 * | 12/2009 | Funahashi | 381/423 |
| 7,844,071 | B2 * | 11/2010 | Funahashi et al. | 381/403 |
| 7,899,204 | B2 * | 3/2011 | Kuribayashi et al. | 381/423 |
| 2006/0215871 | A1 * | 9/2006 | Funahashi et al. | 381/396 |
| 2009/0052724 | A1 * | 2/2009 | Umemura | 381/398 |
| 2009/0262971 | A1 * | 10/2009 | Funahashi | 381/398 |
| 2010/0215207 | A1 * | 8/2010 | Funahashi | 381/400 |
| 2010/0296688 | A1 * | 11/2010 | Funahashi | 381/398 |

FOREIGN PATENT DOCUMENTS

| | | |
|---|---|---|
| JP | 55-168294 | 12/1980 |
| JP | 2000-244999 | 9/2000 |
| JP | 2005080098 | * 3/2005 |
| JP | 2005-295452 | 10/2005 |
| JP | 2006-121602 | 5/2006 |

OTHER PUBLICATIONS

International Search Report for PCT/JP2008/001086; May 16, 2008.

* cited by examiner

*Primary Examiner* — Savitr Mulpuri

(74) *Attorney, Agent, or Firm* — Pearne & Gordon LLP

(57) ABSTRACT

A leader line of a voice coil from a conductive wire part is drawn out from a part between a diaphragm coupling part and a part disposed in the magnetic gap toward a frame in a non-contact state with a diaphragm. One end side of the second edge made of an elastic body is coupled to a part between a drawing part of the leader line on the voice coil and a part of the voice coil disposed in the magnetic gap. The other end side of the second edge is coupled to the frame. A suspension holder is integrated with the proximity of a coupling part of the second edge to the voice coil. The suspension holder is stuck to the voice coil using an adhesive. The disturbance of the movement of the voice coil can be reduced.

3 Claims, 3 Drawing Sheets

PRIOR ART

LOUDSPEAKER

This application is a U.S. National Phase Application of PCT International Application PCT/JP2008/001086.

TECHNICAL FIELD

The present invention relates to a loudspeaker for an audio apparatus.

BACKGROUND ART

FIG. 3 is a sectional view showing a conventional loudspeaker. In FIG. 3, the loudspeaker used for various audio apparatuses has the following elements:

magnetic circuit 2 having magnetic gap 1;

voice coil 4 whose conductive wire 3 part is disposed movably in magnetic gap 1 of magnetic circuit 2;

diaphragm 5 whose inner end side is coupled to a part of voice coil 4 outside magnetic gap 1;

first edge 7 for making frame 6 hold the outer end side of diaphragm 5; and damper 8 whose inner end side is coupled to a part between the coupling part of voice coil 4 to diaphragm 5 and a part of voice coil 4 disposed in magnetic gap 1 and outer end side is coupled to frame 6.

Damper 8 has a ring shape and elasticity. Leader line 9 of voice coil 4 from conductive wire 3 is drawn out from a part between the coupling part of voice coil 4 to diaphragm 5 and the part of voice coil 4 disposed in magnetic gap 1 toward frame 6 in a non-contact state with diaphragm 5. The technology related to this is disclosed in patent document 1.

In the conventional example, the reason why leader line 9 of voice coil 4 from conductive wire 3 is drawn out from the part between the coupling part of voice coil 4 to diaphragm 5 and the part of voice coil 4 disposed in magnetic gap 1 toward frame 6 in the non-contact state with diaphragm 5 is shown below. The accident is prevented that stress due to vibration of diaphragm 5 is excessively added to leader line 9 to cause disconnection. Since leader line 9 is drawn out from an intermediate part of voice coil 4, diaphragm 5 is mounted to voice coil 4 from the upside, and damper 8 is mounted to voice coil 4 from the downside.

The problem of this structure is that a part of an adhesive for fixing damper 8 to voice coil 4 flows down from the upside toward conductive wire 3 and hence the width of magnetic gap 1 is narrowed. In other words, conductive wire 3 is wound around the lower part of voice coil 4, so that the outer diameter of this part is large. The opening diameter of damper 8 must be large in order to pass this part, and a large clearance occurs between the outer diameter of voice coil 4 and the opening diameter of damper 8 in a state where damper 8 is disposed in the intermediate part of voice coil 4. As a result, a part of the adhesive for fixing damper 8 to voice coil 4 flows down from the upside toward conductive wire 3, the width of magnetic gap 1 is narrowed, and the movement of voice coil 4 can be disturbed.

[Patent document 1] Japanese Patent Unexamined Publication No. H02-241297

SUMMARY OF THE INVENTION

A loudspeaker of the present invention has the following elements:

a magnetic circuit having a magnetic gap;

a cylindrical voice coil whose conductive wire part is disposed movably in the magnetic gap of the magnetic circuit; and a diaphragm whose part is coupled to a part of the voice coil outside the magnetic gap.

The loudspeaker also has a second edge whose inner periphery is coupled to a part between the coupling part of the voice coil to the diaphragm and a part of the voice coil disposed in the magnetic gap and that holds the voice coil. The coupling part of the second edge to the voice coil is thinner than coupling part 18*b* of the second edge to frame 15. In a state that does not receive force, the inner diameter of the thin part is smaller than the outer diameter of the voice coil in the coupling part between the second edge and the voice coil. The outer diameter of the thin part is larger than the outer diameter of the conductive wire part in the magnetic gap. In addition, the loudspeaker has a ring-like suspension holder in order to reinforce the adhesion of the voice coil to the second edge.

In the present invention having this structure, the cylindrical voice coil is made to penetrate the second edge that deforms elastically. In assembling this structure, the conductive wire part of the voice coil can be passed through the opening of the second edge while the opening is elastically deformed to be increased in diameter. After the pass, the opening fast adheres to the outer peripheral surface of the intermediate part of the voice coil while the opening is elastically deformed to be decrease in diameter. Therefore, even when an adhesive for fixing the voice coil to the suspension holder is applied from the upside, a part of the adhesive does not flow to the downside of the second edge, and hence the movement of the voice coil is not disturbed.

REFERENCE MARKS IN THE DRAWINGS

Figure 1:
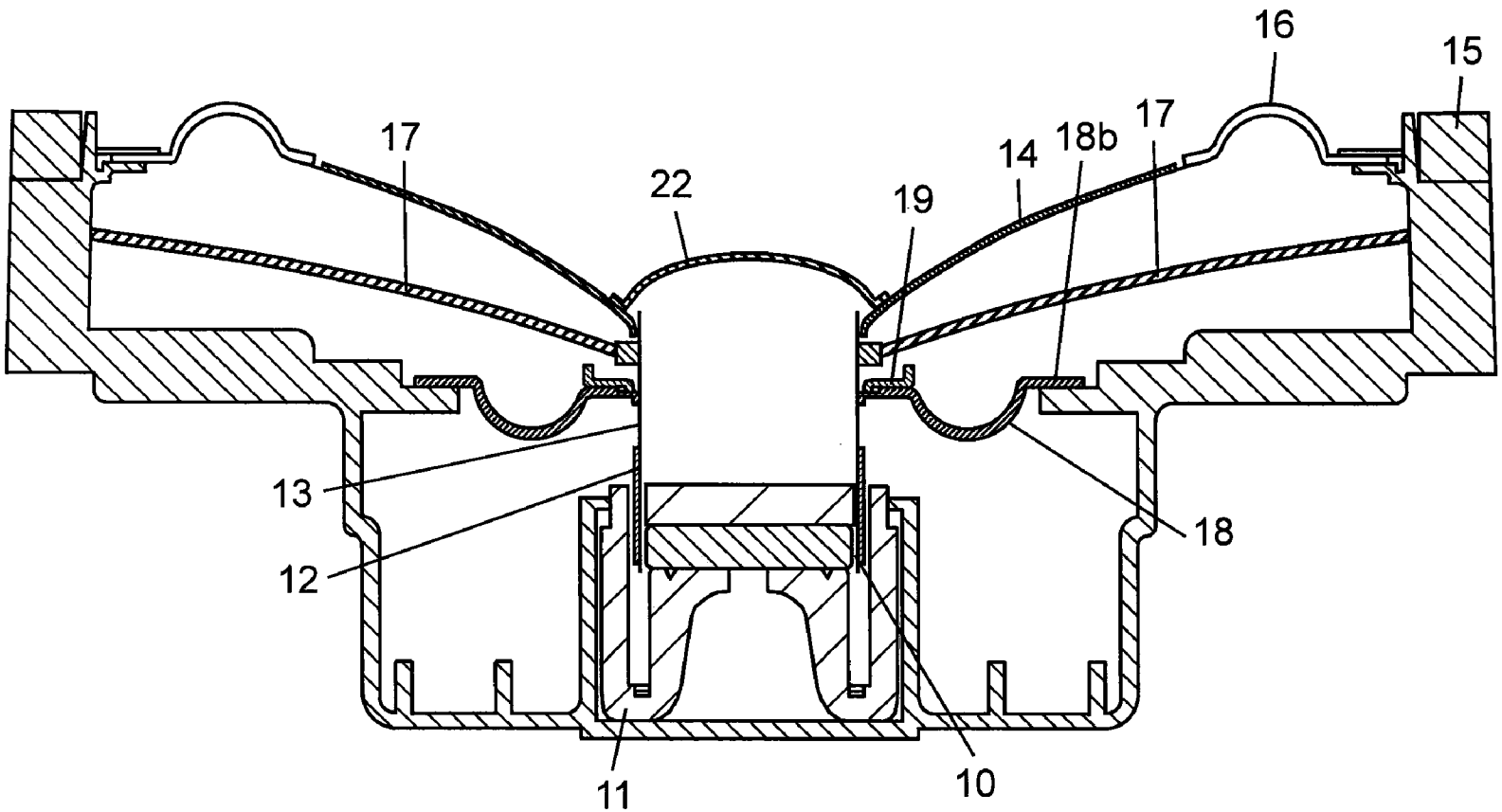
FIG. 1 is a sectional view showing a loudspeaker in accordance with an exemplary embodiment of the present invention.

10 magnetic gap
11 magnetic circuit
12 conductive wire
13 voice coil
14 diaphragm
15 frame
16 first edge
17 leader line
18 second edge
19 suspension holder
21 adhesive

DETAILED DESCRIPTION OF PREFERRED EMBODIMENTS

Figure 2:
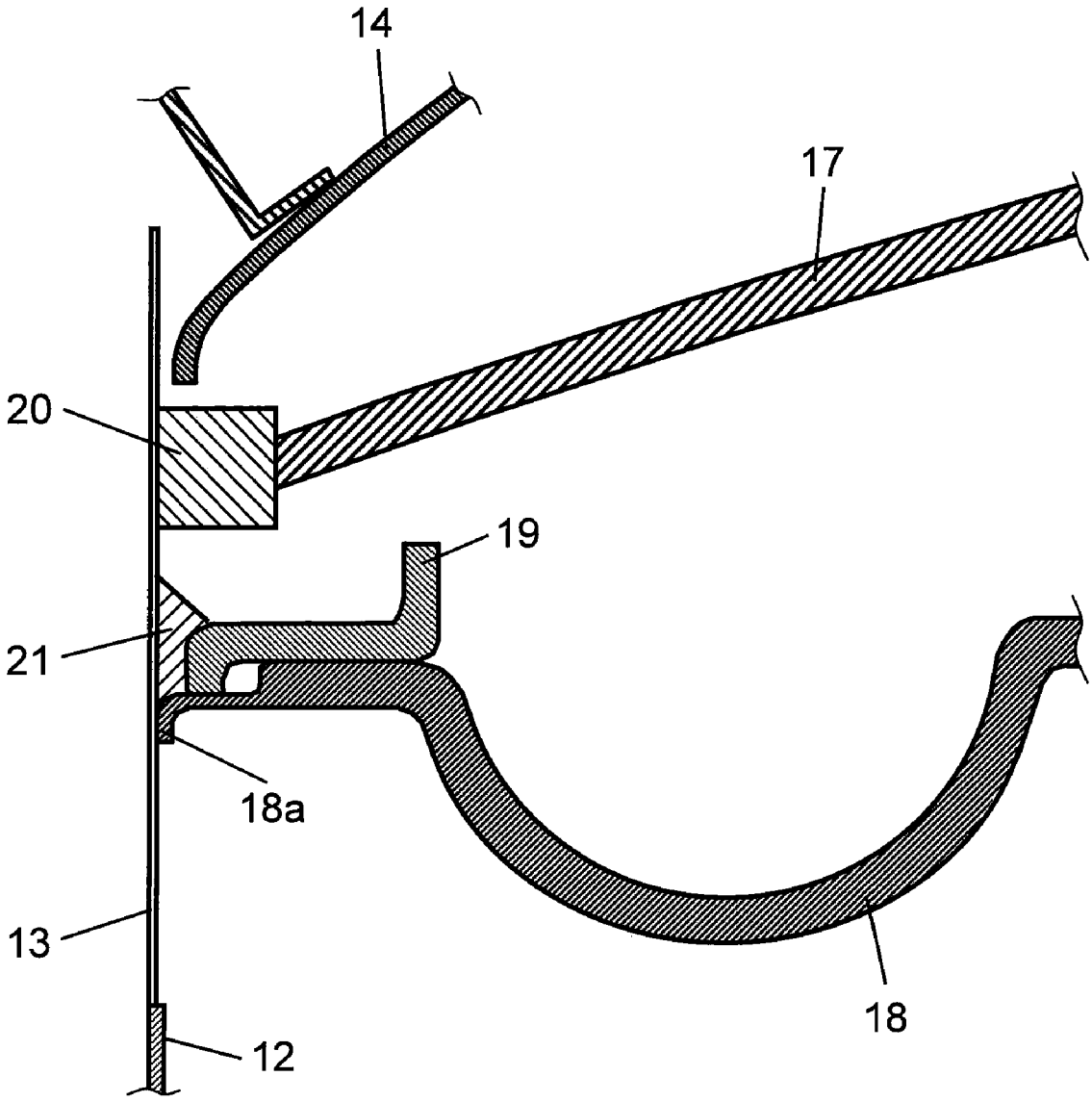
FIG. 2 is an enlarged sectional view of an essential part showing a loudspeaker in accordance with an exemplary embodiment of the present invention.
Figure 3:
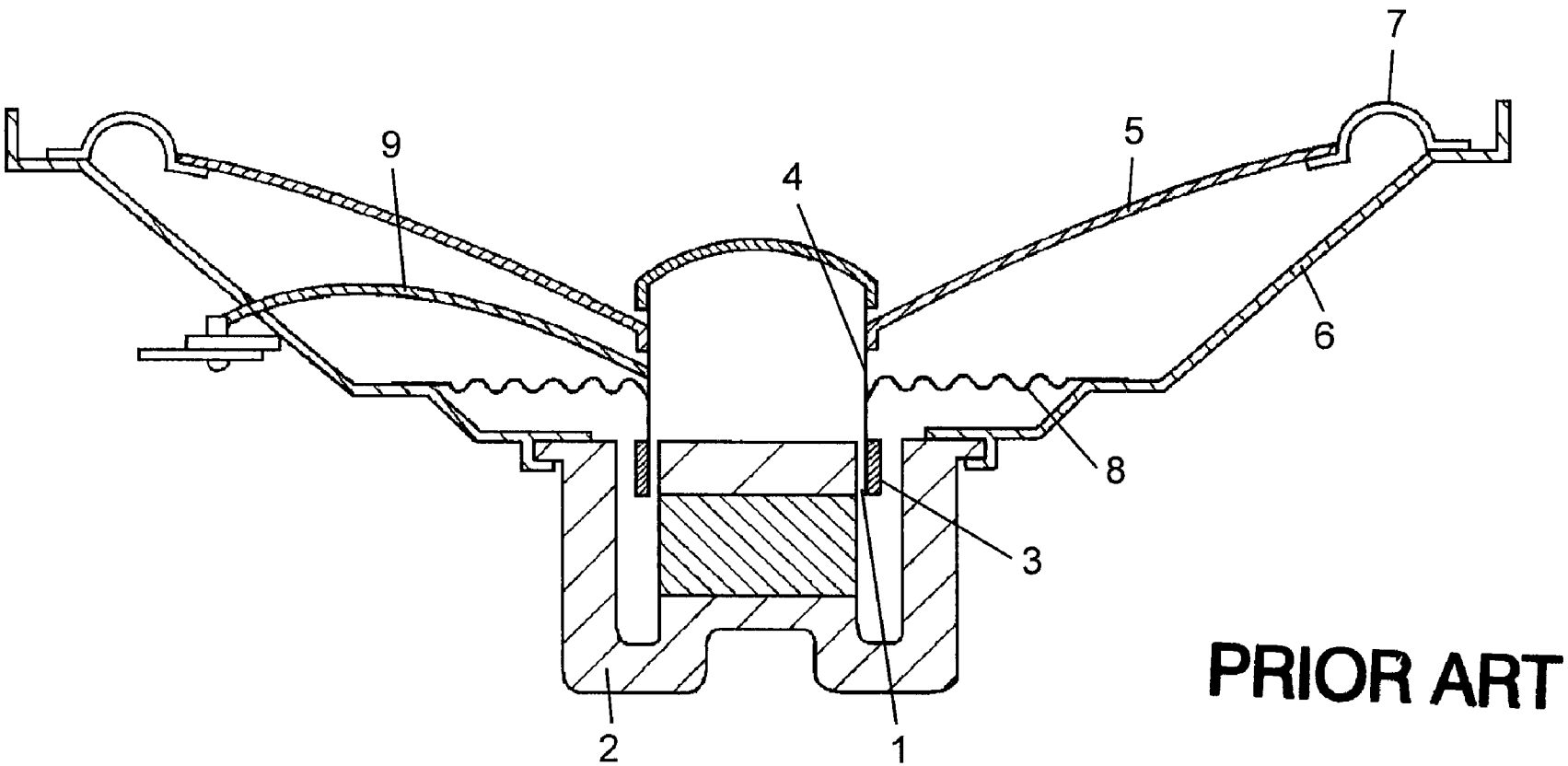
FIG. 3 is a sectional view showing a conventional loudspeaker.

An exemplary embodiment of the present invention is described using FIG. 1 and FIG. 2. FIG. 1 is a sectional view showing a loudspeaker in accordance with the exemplary embodiment of the present invention. As shown in FIG. 1, the loudspeaker of the present exemplary embodiment has the following elements:

magnetic circuit 11 having cylindrical magnetic gap 10;

cylindrical voice coil 13 whose conductive wire 12 part is disposed movably in magnetic gap 10 of magnetic circuit 11;

disk-like diaphragm 14 whose inner peripheral part is coupled to a part of voice coil 13 outside magnetic gap 10; and first edge 16 having a ring-like plane shape that makes the opening in the upper surface of bowl-like frame 15 hold a part of voice coil 13 other than the coupling part of diaphragm 14 to voice coil 13.

Leader line 17 of voice coil 13 from conductive wire 12 is drawn out from a part between the coupling part of voice coil 13 to diaphragm 14 and a part (intermediate part) of voice coil 13 disposed in magnetic gap 10 toward frame 15 in a non-contact state with diaphragm 14. The inner peripheral side of second edge 18 is coupled to a part between the drawing part of leader line 17 on voice coil 13 and a part of voice coil 13 disposed in magnetic gap 10. Here, second edge 18 is made of an elastic body and has a ring-like plane shape. The other end side of second edge 18 is butted on the intermediate part of the inner surface of frame 15.

Second edge 18 and first edge 16 are made of an elastic body such as urethane or rubber. Second edge 18 projects downward, and first edge 16 projects upward, namely in the opposite direction to that of second edge 18. Hard suspension holder 19 having a ring-like plane shape is stuck by an adhesive to the upper surface (surface on the diaphragm 14 side) near the coupling part of second edge 18 to voice coil 13.

FIG. 2 is an enlarged sectional view of an essential part of FIG. 1. The coupling part of second edge 18 to voice coil 13 projects to the inside of suspension holder 19 as shown in FIG. 2, and the projecting part 18*a* is thinner than coupling part 18*b* of second edge 18 to frame 15. In a state of free from force, the inner diameter of the thin part is smaller than the outer diameter of the voice coil in the coupling part. The inner diameter of suspension holder 19 is slightly larger than the outer diameter of the part of conductive wire 12 of voice coil 13. Leader line 17 has a twisted shape called a gold thread line. The tip of it is connected electrically and mechanically to the tip (not shown) of conductive wire 12 on the outer peripheral surface of the intermediate part of voice coil 13 by soldering 20.

In assembling the loudspeaker shown in FIG. 1, magnetic circuit 11 is firstly mounted in frame 15, second edge 18 is mounted in frame 15, the lower end of voice coil 13 is inserted downward into the opening of second edge 18 from the upside of frame 15, and conductive wire 12 is held at a predetermined position of magnetic gap 10. At this time, suspension holder 19 is already stuck to the upper surface side of second edge 18 by an adhesive.

Then, adhesive 21 is dropped downward from the upside of projecting part 18*a* of second edge 18 so as to cover the upper part of suspension holder 19, the upper part of projecting part 18*a* of second edge 18, and a part of suspension holder 19 near them, thereby integrally holding suspension holder 19 on voice coil 13.

Conductive wire 12 is wound on the outer periphery of the lower end of voice coil 13, so that the outer periphery of a part of voice coil 13 having this conductive wire has a diameter larger than those of the intermediate part and upper part of voice coil 13. However, second edge 18 is made of the elastic body, so that second edge 18 can pass the conductive wire 12 part of voice coil 13 while the opening of second edge 18 is elastically deformed to be increased in diameter. Especially, when the outer diameter of the thin part is larger than the outer diameter of the conductive wire part, the conductive wire part can be easily passed.

The inner diameter of the thin part is smaller than the outer diameter of voice coil 13 in the coupling part of voice coil 13 to second edge 18. After the passing, second edge 18 fast adheres to the outer peripheral surface of the intermediate part of voice coil 13 while the opening is elastically deformed to be decreased in diameter. Therefore, even when adhesive 21 for fixing voice coil 13 to suspension holder 19 is applied from the upside, projecting part 18*a* of second edge 18 fast adhering to the outer peripheral surface of the intermediate part of the voice coil in the elastically deformed diameter-decreased state prevents a part of adhesive 21 from flowing down to the downside of second edge 18 and prevents the movement of voice coil 13 from being disturbed.

Since projecting part 18*a* of second edge 18 is thin and is made of the elastic body, the diameter-increasing elastic deformation and diameter-decreasing elastic deformation are further facilitated, and the effect of suppressing the movement disturbance of voice coil 13 is further certainly produced. Projecting part 18*a* of second edge 18 fast adheres to the outer peripheral surface of voice coil 13 in a large area in a downwardly deflected state as shown in FIG. 2, thereby preventing flow down of adhesive 21.

Subsequently, leader line 17 is wired and coupled, then the inner periphery of diaphragm 14 is made to penetrate the outer periphery of the upper end of voice coil 13, the outer periphery of the upper end of voice coil 13 is fixed to the inner periphery of diaphragm 14 by an adhesive, and the opening in the upper surface of frame 15 is fixed to ring-like first edge 16 by an adhesive. Finally, the upper end of voice coil 13 is covered with dust cap 22, and the assembling is completed.

In this assembled loudspeaker, adhesive 21 does not flow down to the conductive wire part, so that adhesive 21 does not disturb the movement of voice coil 4. Since hard suspension holder 19 is stuck and fixed to the proximity of the inner periphery of second edge 18 and is tightly stuck to voice coil 13 by adhesive 21, the voice coil is certainly held by second edge 18.

In the loudspeaker completed through the above-mentioned processes, first edge 16 projects upward and second edge 18 projects downward as shown in FIG. 1. First edge 16 and second edge 18 for supporting the upper part and intermediate part of voice coil 13 on frame 15 have shapes projecting in the opposite directions, so that the upward and downward movable loads of voice coil 13 are close to each other. Therefore, the upward and downward movable loads of diaphragm 14 are also close to each other. As a result, the loudspeaker has low strain.

INDUSTRIAL APPLICABILITY

In a loudspeaker of the present invention, even when an adhesive for fixing a voice coil to a suspension holder is applied from the upside, a part of the adhesive does not flow down to the downside of the second edge and does not disturb the movement of the voice coil. The loudspeaker is useful for various audio apparatuses.

The invention claimed is:

1. A loudspeaker comprising:

a magnetic circuit having a magnetic gap;

a voice coil whose conductive wire part is disposed movably in the magnetic gap of the magnetic circuit;

a diaphragm whose part is coupled to a part of the voice coil outside the magnetic gap; and a first edge for holding a part, which is other than a coupling part of the diaphragm to the voice coil, of the diaphragm to a frame, wherein a leader line of the voice coil from the conductive wire part is drawn out from a part between the coupling part of the voice coil to the diaphragm and a part of the voice coil disposed in the magnetic gap toward the frame in a non-contact state with the diaphragm, wherein one end side of a second edge made of an elastic body is coupled to a part between a drawing part of the leader line of the voice coil and the part of the voice coil disposed in the magnetic gap, and the other end side of the second edge is coupled to the frame, wherein the second edge and the first edge have shapes projecting in opposite directions, wherein a suspension holder is integrated with a surface on the diaphragm side near a coupling part of the second edge to the voice coil, and wherein the suspension holder is stuck to the voice coil using an adhesive.

2. The loudspeaker of claim 1, wherein the coupling part of the second edge to the voice coil is thinner than a coupling part of the second edge to the frame.

3. The loudspeaker of claim 1, wherein the inner diameter of second edge is smaller than outer diameter of the voice coil in the coupling part in a state of free from force, and the diameter of suspension holder is larger than the outer diameter of conductive wire of the voice coil in the magnetic gap of the magnetic circuit.

* * * * *